United States Patent [19]

Halttula

[11] Patent Number: 4,782,568

[45] Date of Patent: Nov. 8, 1988

[54] PRESS ROLL

[75] Inventor: Kyösti Halttula, Pirkkala, Finland

[73] Assignee: Oy Tampella AB, Tampere, Finland

[21] Appl. No.: 17,081

[22] Filed: Feb. 20, 1987

[30] Foreign Application Priority Data

Feb. 21, 1986 [FI] Finland ..... 860766

[51] Int. Cl.[4] ..... B21B 27/00

[52] U.S. Cl. ..... 29/123; 29/130; 29/131

[58] Field of Search ..... 29/123, 129, 130, 131

[56] References Cited

U.S. PATENT DOCUMENTS

| | | | |
|---|---|---|---|
| 1,365,606 | 1/1921 | Seymour-Jones | 29/123 |
| 1,435,583 | 11/1922 | Caddell | 29/123 |
| 2,814,855 | 12/1957 | Seary et al. | 29/123 |
| 4,452,141 | 6/1984 | Mistyurik | 29/123 |

FOREIGN PATENT DOCUMENTS

| | | | |
|---|---|---|---|
| 1280873 | 1/1961 | France | 29/123 |
| 1347194 | 11/1962 | France | 29/123 |
| 25489 | of 1909 | United Kingdom | 29/123 |

*Primary Examiner*—Howard N. Goldberg
*Assistant Examiner*—Irene Cuda
*Attorney, Agent, or Firm*—Birch, Stewart, Kolasch & Birch

[57] ABSTRACT

The invention relates to a press roll arranged to interact with a second roll in the wet end of a paper or paper board machine for forming a nip between the rolls. In the press roll a surface is arranged to be pressed against the second roll and is made of an elastic material for extending the nip. In order to provide a simple and versatile structure, the surface made of an elastic material is formed by a separate shell portion which surrounds a body of the press roll and is positioned over its entire length at a distance from the body. The shell portion is supported to be stationary with respect to the body by means of end flanges provided in the ends of the body, so that the shell portion is able to yield over the entire length thereof radially inwards towards the body locally at the nip point.

6 Claims, 1 Drawing Sheet

PRESS ROLL

FIELD OF THE INVENTION

The present invention releates to a press roll arranged to interact with a second roll in the wet end of a paper or paper board machine for forming a nip between the rolls, in which press roll a surface is arranged to be pressed against the second roll and is made of an elastic material for extending the nip.

DESCRIPTION OF THE BACKGROUND ART

These kind of press rolls intended for forming a nip are well-known in the art. Prior art solutions include e.g. the structure disclosed in German Patent Specification No. 279,107. A drawback of this known device is its relatively complicated structure and that the roll width has to be great, because the rigid fastenings of an elestric shell at the ends of the rolls cause problems in use. Consequently, the roll has to be so broad that the different bending of the elastic shell at the ends of the roll does not cause problems. However, an increased roll width results in problems caused by bending, which requires an even more complicated structure.

The structure described in PCT Patent Application No. WO 82/02567 may be mentioned as another example of prior solutions. In this solution the body of the roll is unrotatable, and, in addition, provided with a backing block arranged at the press point. A rotating surface layer of an elastic material is provided around the roll body and the backing block. This surface layer of an elastic material is positioned close against the body, and lubrication is provided between the body and the surface layer. A drawback of this known solution is its complexity and the sealing problems caused by the lubricant and the pressure medium.

A third example of the prior art would be the solution disclosed in Finnish Patent Application No. 840,795. This structure, too, utilizes a stationary roll body in which a press shoe is arranged. An elastic press band rotatable with respect to the body is arranged around the body and the press shoe. Oil is applied between the band and the body in order to cool the press band and to lubricate the slide surface of the press shoe. This known solution has the same drawbacks as described above in connection with PCT Patent Application No. WO 82/02567.

SUMMARY OF THE INVENTION

The object of the present invention is to provide a press roll which avoids the drawbacks of the prior art. This is achieved by means of a press roll according to the invention which is characterized in that the surface made of an elastic material is formed by a separate shell portion which surrounds a body of the press roll, is positioned over its entire length at a distance from the body, and is supported to be stationary with respect to the body by means of end flanges provided in the ends of the body so that the shell portion is able to yield over the entire length thereof radially inwards towards the body locally at the nip point.

The invention is advantageous mainly in that it is simple, and, accordingly, the manufacturing and operating costs are low. The roll may also be narrower than the roll according to German Patent Specification No. 279,107, because the elasticity of the shell portion of the roll does not vary over the length of roll, the drawbacks of a prior rigid fastening are eliminated. Further, the use of the press roll according to the invention is very flexible because the elasticity of the roll and, consequently, the press pattern thereof, can be varied by the use of materials differing suitably in elasticity, either alone or in combination.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be described in the following in more detail by means of one preferred embodiment shown in the attached drawings which are given by way of illustration only, and thus are not limitative of the present invention, and wherein.

BRIEF DESCRIPTION OF THE PREFERRED EMBODIMENTS

Figure 1:
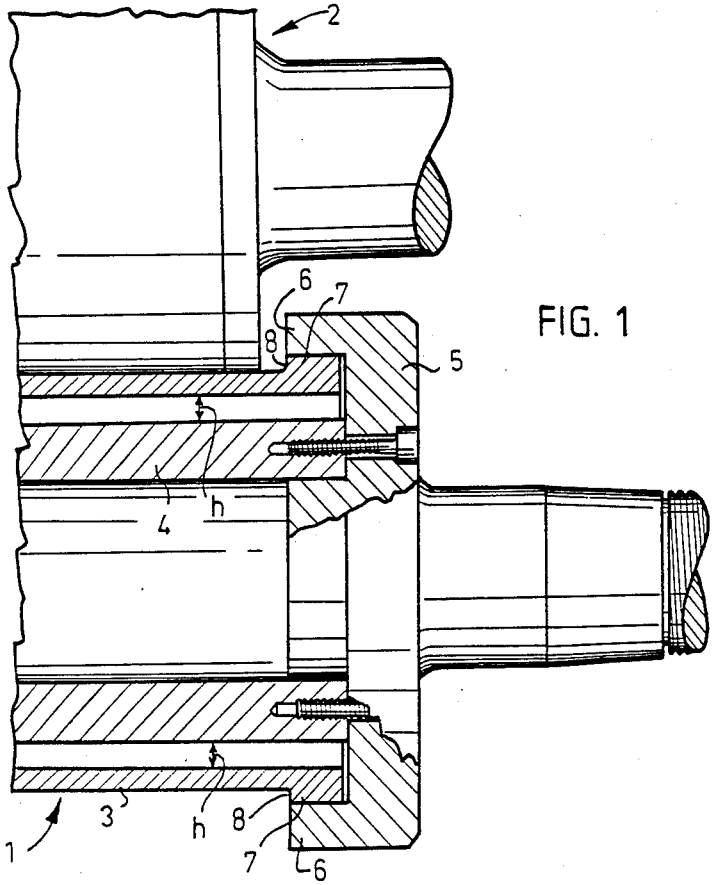
FIG. 1 is a general side view of a press comprising a press roll according to the invention.

In the example of the figures, the press is formed by two press rolls 1 and 2. The rolls 1 and 2 are thereby arranged to be pressed against each other so that a nip is formed at their contact point. When a paper machine, for instance, is provided with a press formed as described above, a fiber web is arranged to be led through the nip together with a felt. The rolls naturally rotate during the operation. The press effect created at the nip point causes the moisture contained in the fiber web to be transferred to the felt. After the nip, the fiber web and the felt are separated from each other, and the web is passed onto further treatment. The felt, which goes round as an endless loop, is first exposed to a drying treatment and then led through the nip again. The fiber web and the felt are not shown in the figures. These matters are completely obvious to one skilled in the art, so they are not more fully described.

In the example of the figures, the press roll 1 is formed according to the invention in the following way. In order to extend the nip, the roll 1 comprises two shell structures, whereby the surface made of an elastic material is formed by a separate shell portion 3 which is supported in position on the body of the roll 1, e.g. on a supporting cylinder 4, solely by means of end flanges 5 provided in the ends of the body. The shell portion 3 is supported around the body 4 so that a predetermined distance h is defined between the inner surface of the shell portion and the surface of the body. The support for the shell portion 3 is so arranged that it is able to yield radially inwardly over its entire length towards the body 4 locally at the nip point. In addition, the rotation of the shell portion 3 with respect to the body 4 is prevented, so that it rotates together with the body. Consequently, the shell portion 3 is made of a material which is self-supporting in a free space, i.e. keeps its shape in a free space so that the distance h is maintained. However, the shell portion 3 is sufficiently elastic to follow the shape of the roll 2 in the desired manner.

The end flanges 5 are preferably cup-shaped parts with edges 6 arranged to be directed towards the transverse axis of symmetry of the roll. The edges 6 are thereby arranged to surround the outer surfaces of the ends of the shell portion 3. The inner surface of the edges 6 is thereby preferably provided with means 7, and the outer surfaces of the ends of the shell portion correspondingly with means 8 for preventing the shell portion 3 and the body 4 from rotating with respect to each other. Said means 7 and 8 may be formed e.g. by interlocking coggings.

Accordingly, an essential aspect of the structure described above is that the shell portion is wholly separate, and it is not actually at all fastened on the body 4. Only the rotation of the shell portion 3 with respect to the body is prevented e.g. by means of the above-mentioned coggings. So the local buckling movement of the shell portion 3 over its entire length radially towards the body is not prevented in any way.

Figure 2:
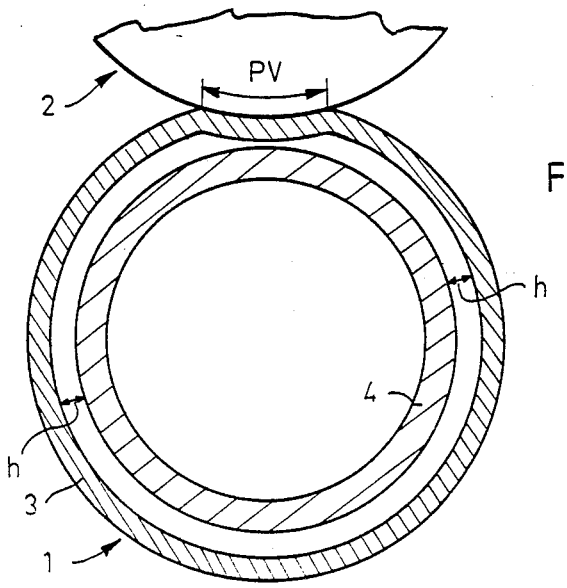
FIG. 2 is a general view of the press of FIG. 1 in the axial direction of the press roll.

In principle, the press roll according to the invention operates in a press in the following way. FIG. 2 in particular is referred to herein. When the press is in operation, the rolls 1, 2 rotate, and the web as well as the felt (not shown in the figures) are led through a nip formed between the rolls. At the nip, the shell portion 3 is pressed in a direction towards the body 4, being shaped according to the surface of the roll 2. Thereby the nip, linear in principle, is extended into a press zone PV. Such an extended nip is known per se in the art. When the shell portion is pressed locally towards the body over its entire length, i.e. when it buckles towards the body, the ends of the shell portion also yield, being in no way prevented from moving radially inwards similarly as the rest of the shell portion. As a result, the ends of the shell portion lose contact with the inner surface of the edge 6 of the end flange 5 at the nip point. The shell portion 3 thus follows the shape of the roll 2 over the entire length thereof at the nip, so that the drawbacks of the prior art rigid fastening are eliminated.

The above example is by no means intended to restrict the invention, but the invention can be modified within the scope of the attached claims in various ways. Accordingly, it is self-evident that the roll or the different parts thereof do not need to be exactly similar to those shown in the figures, but other kind of solutions can be used as well. The roll may be manufactured of any material. The body can be made of any suitable rigid material, such as cast iron, steel, carbon fiber or some other material generally used in rolls. The shell portion, in turn, can be made of plastic, fiber glass, carbon fiber, steel, bronze or some other suitable material by means of which the desired elasticity and strength can be obtained. The shell portion as well as the body portion may also be coated with rubber, plastic or some other elastic material. In addition, the bending of the structure according to the invention can be compensated by cambering the body, the shell portion or both. The compensation can also be carried out by cambering a backing roll, or some of these elements can be cambered in combination. Also, bendings can be compensated and the moisture profile can be altered by forming pneumatic or hydraulic zones between the shell portion and the body, so that these zones can be exposed to different pressures. If necessary, elastic supporting means can be provided between the body and the shell portion, or some kind of additional supporting layer can be provided between the shell and the body; this layer, however, should be more elastic than the shell. The function of the additional supporting layer is to provide additional elasticity in the formation of the elasticity pattern, for instance. The additional supporting layer may fill the space defined between the shell portion and the body entirely or partly. In the latter case, the additional supporting layer may be arranged on the surface of the body, for example, so that an empty space is defined between the free surface of the supporting layer and the inner surface of the shell portion. The additional supporting layer may be made of e.g. foam plastic or some other porous foam. It is also possible to use various air cushions. The shell portion can be operated e.g. by means of a cogging provided between a driving flange shaft and the shell portion or by some other suitable mechanism. Both rolls in the press can be constructed according to the invention. The diameter of a roll according to the invention can, of course, be selected as required. The length of the nip depends on the diameters of the rolls. The range from 100 to 200 mm may be mentioned as an example of nip lengths obtainable by means of the solution according to the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A rotatable press roll arranged to interact with a second roll in the wet end of a paper of a paper board machine for forming a nip between rolls, said press roll comprising a surface arranged to be pressed against the second roll and being made of an elastic material for extending the nip, said elastic material surface being formed by a separate shell portion surrounding a body of the press roll, and being positioned over its entire length at a distance from the body to form a space therebetween, said surface being further supported to be nonrotatable with respect to the body be means of end flanges provided in the ends of the body and contacting each end of said surfaces, the shell portion and the ends thereof being readily yieldable over the entire length thereof radially inwards towards the body locally at the nip point whereby a section of said shell portion in contact with said second roll temporarily deforms along with the end portions of said section of said shell portion.

2. The press roll according to claim 1, wherein the end flanges are cup-shaped parts with edges directed axially towards the transverse axis of symmetry of the roll, said edges being arranged to surround and engage the outer surfaces of the ends of the shell portion, and rotation of the shell portion with respect to the body is prevented by means provided in the inner surfaces of the edges and by means provided in the outer surfaces of the ends of the shell portion, said ends of said section of said shell portion in contact with said second roll becoming temporarily disengaged from said edges of said end flanges while said section of said sell portion is in contact with said second roll.

3. The press roll according to claim 2, wherein the means in the inner surfaces of the edges and the means in the outer surfaces of the ends of the shell portion are formed by interlocking coggings.

4. The press roll according to claim 1 wherein material of a greater elasticity than the material of the shell portion is provided in the space defined between the inner surface of the shell portion and the body, the height of the space in the radial direction being said distance.

5. The press roll according to claim 2, wherein material of a greater elasticity than the material of the shell portion is provided in the space defined between the inner surface of the shell portion and the body, the height of the space in the radial direction being said distance.

6. The press roll according to claim 3, wherein material of a greater elasticity than the material of the shell portion is provided in the space defined between the inner surface of the shell portion and the body, the height of the space in the radial direction being said distance.

* * * * *